US010168644B2

(12) United States Patent
Bhattacharyya et al.

(10) Patent No.: US 10,168,644 B2
(45) Date of Patent: Jan. 1, 2019

(54) COMPOSITE COATING AND SUBSTRATE USED IN LIQUID ELECTROPHOTOGRAPHIC PRINTING AND METHOD

(71) Applicant: Hewlett-Packard Development Company, L.P., Fort Collins, CO (US)

(72) Inventors: Manoj K. Bhattacharyya, Palo Alto, CA (US); Hou T. Ng, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 471 days.

(21) Appl. No.: 14/957,143

(22) Filed: Dec. 2, 2015

(65) Prior Publication Data

US 2016/0085182 A1 Mar. 24, 2016

Related U.S. Application Data

(62) Division of application No. 12/997,100, filed as application No. PCT/US2008/071270 on Jul. 25, 2008, now abandoned.

(51) Int. Cl.

| | |
|---|---|
| ***G03G 7/00*** | (2006.01) |
| ***G03G 15/10*** | (2006.01) |
| ***B05D 3/00*** | (2006.01) |

(52) U.S. Cl.

CPC ..... *G03G 15/10* (2013.01); *B05D 3/007* (2013.01); *G03G 7/00* (2013.01); *G03G 7/004* (2013.01);

(Continued)

(58) Field of Classification Search

CPC .... G03G 7/004; G03G 7/0046; G03G 7/0033; G03G 7/00; G03G 7/0013; G03G 15/10; Y10T 428/24802

See application file for complete search history.

(56) References Cited

U.S. PATENT DOCUMENTS

| | | | |
|---|---|---|---|
| 4,770,934 | A | 9/1988 | Yamasaki et al. |
| 5,215,851 | A | 6/1993 | Tomita et al. |

(Continued)

FOREIGN PATENT DOCUMENTS

| | | |
|---|---|---|
| EP | 1658993 | 5/2008 |
| JP | 57034561 | 2/1982 |

(Continued)

OTHER PUBLICATIONS

Sigma-Aldrich, Product Specification for CAS No. 9002-89-5, Jan. 2013.

(Continued)

*Primary Examiner* — Gerard Higgins

(74) *Attorney, Agent, or Firm* — Thorpe North & Western LLP

(57) ABSTRACT

A digital-printing substrate and method of improving adhesion of a substrate to an liquid electrophotographic (LEP) ink in LEP printing both employ a composite coating. The composite coating includes from 4.5% to 9.5% by weight of a mineral pigment and from 0.5% to 2% by weight of an organic binder uniformly dispersed in water. The mineral pigment has a particle size less than 1 micron. The organic binder comprises a hydroxylated polymer having an average molecular weight greater than 50,000. A weight percentage of hydroxyl groups in the hydroxylated polymer is equal to or greater than a weight percentage of acidic groups in an LEP ink. The composite coating enhances adhesion of the LEP ink to the substrate comprising the composite coating dried on a surface of the substrate.

15 Claims, 1 Drawing Sheet

(52) U.S. Cl.
CPC ..... *G03G 7/0013* (2013.01); *G03G 7/0033* (2013.01); *G03G 7/0046* (2013.01); *Y10T 428/24372* (2015.01); *Y10T 428/24802* (2015.01); *Y10T 428/249953* (2015.04); *Y10T 428/25* (2015.01)

(56) References Cited

U.S. PATENT DOCUMENTS

| | | | |
|---|---|---|---|
| 5,320,672 | A | 6/1994 | Whalen-Shaw |
| 5,320,923 | A | 6/1994 | Nguyen |
| 5,322,879 | A | 6/1994 | Gane et al. |
| 5,605,725 | A | 2/1997 | Macaulay et al. |
| 5,681,876 | A | 10/1997 | Schneider et al. |
| 5,824,396 | A | 10/1998 | Missell |
| 5,879,512 | A | 3/1999 | McGenity et al. |
| 6,146,803 | A | 11/2000 | Landa et al. |
| 6,414,065 | B1 | 7/2002 | Boylan |
| 6,426,383 | B1 | 7/2002 | Fong et al. |
| 6,623,902 | B1 | 9/2003 | Ben-Avraham et al. |
| 7,081,305 | B2 | 7/2006 | Distler et al. |
| 2001/0023047 | A1 | 9/2001 | Srinivasan |
| 2004/0054037 | A1 | 3/2004 | Abbeele van den et al. |
| 2004/0244928 | A1 | 12/2004 | Huang et al. |
| 2005/0215675 | A1 | 9/2005 | Nishida et al. |
| 2005/0238860 | A1 | 10/2005 | Nakanishi et al. |

FOREIGN PATENT DOCUMENTS

| | | | | |
|---|---|---|---|---|
| JP | 57050543 | | | 3/1983 |
| JP | 62158084 | | | 7/1987 |
| JP | 09114122 | A | * | 5/1997 |
| JP | 11095455 | | | 4/1999 |
| JP | 2005120121 | | | 5/2005 |
| JP | 2005301186 | | | 10/2005 |
| JP | 2005309328 | | | 11/2005 |
| JP | 2006023633 | | | 1/2006 |
| JP | 2007313905 | | | 12/2007 |
| WO | 9309289 | | | 5/1993 |
| WO | 9509948 | | | 4/1995 |
| WO | 0122172 | | | 3/2001 |
| WO | 2005072956 | | | 8/2005 |

OTHER PUBLICATIONS

European Search Report dated Mar. 9, 2012 for Application No. 08796676.8 (PCT/US2008/071270), Applicant Hewlett-Packard Development Company, L.P.

Webb, A Mechanism for the Adhesion of Indigo Electro-Ink to Coated Papers, (Viewgraph Presentation) PIRA Ink on Paper Conference, Sep. 27, 2006, 24 slides, copyright of Hewlett-Packard Co.

Webb, A Mechanism for the Adhesion of Indigo Electro-Ink to Coated Papers, (Viewgraph Presentation) IPRIME Annual Meeting, Jun. 2005, 19 slides, copyright of Hewlett-Packard Co.

Wang, Thesis Title: Effect of Coating Polymers on Print Quality of GCC and PCC Coated Ink Jet Paper, Abstract only (3 pages), Asian Institute of Technology, 2007.

Donigian, Ink-Setting Mechanism for Use on High-Performance Papers, GATFWorld, Jun. 2005, pp. 18-20, 22, vol. 17, No. 3, Copyright 2005 Printing Industries of America/Graphic Arts Technical Foundation.

International Search Report and Written Opinion dated Mar. 25, 2009 for International Application No. PCT/US2008/071270, Applicant Hewlett-Packard Development Company, et al.

Webb, et al., A Mechanism for the Adhesion of Indigo Electro-Ink to Coated Papers, Research Disclosure (Res. Discl.) ISSN 0374-4353, 2006, pp. 1463-1466 (5 pages), No. 511, Kenneth Mason Publications, copyright 20074 INIST-CNRS.

* cited by examiner

COMPOSITE COATING AND SUBSTRATE USED IN LIQUID ELECTROPHOTOGRAPHIC PRINTING AND METHOD

CROSS-REFERENCE TO RELATED APPLICATIONS

The present application is a divisional of U.S. patent application Ser. No. 12/997,100, filed on Dec. 9, 2010, which is a 371 national stage application of PCT/US2008/071270, filed on Jul. 25, 2008, each of which is incorporated herein by reference.

STATEMENT REGARDING FEDERALLY SPONSORED RESEARCH OR DEVELOPMENT

N/A

BACKGROUND

1. Technical Field

The invention relates to liquid electrophotographic printing. In particular, the invention relates to a composite coating for substrates used in liquid electrophotographic printing.

2. Description of Related Art

Digital printing provides numerous options not previously available to consumers. Digital printing can create a printed image directly from digital data. For example, a desktop publishing program can provide text and images in an electronic layout that is transferred to a substrate in a printed format. In the digital printing process, every image can be varied electronically to allow for quick and dynamic generation of printed information. Digital offset printing is a type of digital printing that uses an offset cylinder. With respect to some digital offset presses, electronic documents are transferred digitally from workstations directly to the press. Some steps associated with conventional offset printing and their associated costs, such as film output, film assembly and plate processing are eliminated. The offset cylinder associated with some digital printing presses may protect a printing plate of the digital printing press. Moreover, such offset cylinders may extend the life of the printing plate. Further, the offset cylinder may compensate for unevenness in a printing surface of the substrate to be printed. As such, digital offset printing can be used for a wide variety of substrates.

Digital electrophotographic printing is a form of digital printing that is also known as electro-digital printing (EDP). A form of EDP is known as liquid electrophotographic (LEP) printing. Liquid electrophotographic (LEP) printing is different from conventional inkjet printing and laser digital printing in that LEP printing uses a liquid toner based ink, herein referred to as an 'LEP ink' as opposed to a dry toner based ink.

Substrates used in LEP printing include, but are not limited to, paper, various plastics and metal. The substrates may be coated or uncoated. Various substrate coatings may be used, for example, to improve the substrate appearance, to improve image quality of a printed image, and to improve substrate durability during digital printing. For example, a paper substrate may have a coating that is applied by paper manufacturers to strengthen the paper substrate for printing. At the paper manufacturing level, much has been done to improve adhesion between a substrate and such coatings.

However, less has been done to improve adhesion between a coated or uncoated substrate and the LEP ink used in LEP printing. Instead, some manufacturers offer a treatment or primer that either the user applies to a substrate to be printed before or during LEP printing or a substrate manufacturer applies to the substrate. When applied by the user, it is an added step in the LEP printing process. When applied by the substrate manufacturer, the treated or primed substrates may have a limited shelf-life. The surface treatment or primer is designed to improve adhesion between the LEP ink and the substrate. While very effective at the LEP printing level, improved LEP ink adhesion to LEP-compatible substrates should be addressed at the substrate manufacturing level instead of by the user at the digital printing level.

BRIEF SUMMARY

In some embodiments of the present invention, a composite coating for a substrate in liquid electrophotographic (LEP) printing is provided. The composite coating comprises from 4.5% to 9.5% by weight of a mineral pigment, where the mineral pigment has a particle size less than 1 micron. The composite coating further comprises from 0.5% to 2% by weight of an organic binder. The mineral pigment and the organic binder being uniformly dispersed in water. The organic binder comprises a hydroxylated polymer having an average molecular weight greater than 50,000. A weight percentage of hydroxyl groups in the hydroxylated polymer is equal to or greater than a weight percentage of acidic groups in an LEP ink. The composite coating enhances adhesion of the LEP ink to a substrate comprising the composite coating dried on a surface of the substrate.

In other embodiments of the present invention, a digital printing substrate for liquid electrophotographic (LEP) printing is provided. The digital printing substrate comprises a substrate material compatible with the LEP printing and a composite coating incorporated on the substrate material. The composite coating comprises a uniform dispersion of 4.5% to 9.5% by weight of a mineral pigment and 0.5% to 2% by weight of an organic binder. The mineral pigment has a particle size less than 1 micron. The organic binder comprises an hydroxylated polymer having an average molecular weight greater than 50,000. A weight percentage of hydroxyl groups in the hydroxylated polymer is equal to or greater than a weight percentage of acidic groups in an LEP ink. The composite coating enhances adhesion of the LEP ink to the substrate material in liquid electrophotographic (LEP) printing.

In other embodiments of the present invention, a method of improving adhesion of a substrate to a liquid electrophotographic (LEP) ink in LEP printing is provided. The method comprises coating a substrate material with a composite coating. The composite coating comprises 4.5% to 9.5% by weight of a mineral pigment and 0.5% to 2% by weight of an organic binder uniformly dispersed in an aqueous medium. The mineral pigment has a particle size less than 1 micron. The organic binder comprises a hydroxylated polymer having an average molecular weight greater than 50,000. A weight percentage of hydroxyl groups in the hydroxylated polymer is equal to or greater than a weight percentage of acidic groups in the LEP ink. The method further comprises drying the composite coating on the substrate material to form a composite-coated substrate. In a further example, the hydroxylated polymer includes a polyvinyl alcohol that is 98-99% hydrolyzed, and the average molecular weight of the polyvinyl alcohol ranges from 100,000 to 200,000. In another example, the weight percentage of hydroxyl groups in the hydroxylated polymer is less than or equal to 70 weight percent. In yet another example, an amount of the mineral pigment in the composite coating is 5% by weight, the mineral pigment includes one or both of precipitated calcium carbonate and titanium dioxide, the particle size of the mineral pigment is less than or equal to 0.8 microns, an amount of the organic binder in the composite coating is from 1% to 2% by weight, the organic binder includes polyvinyl alcohol and a soluble starch, the polyvinyl alcohol is 98% to 99% hydrolyzed, and the average molecular weight of the polyvinyl alcohol is 130,000. In a still further example, the hydroxylated polymer has a ratio of hydrophobic groups to hydrophilic groups that is equivalent to a ratio of hydrophobic groups to hydrophilic groups of the LEP ink, the hydrophobic groups facilitating additional adhesion between the substrate and the LEP ink.

Certain embodiments of the present invention have other features in addition to and in lieu of the features described hereinabove. These and other features of the invention are detailed below with reference to the following drawings.

BRIEF DESCRIPTION OF THE DRAWINGS

The various features of embodiments of the present invention may be more readily understood with reference to the following detailed description taken in conjunction with the accompanying drawings, where like reference numerals designate like structural elements, and in which.

DETAILED DESCRIPTION

Figure 1:
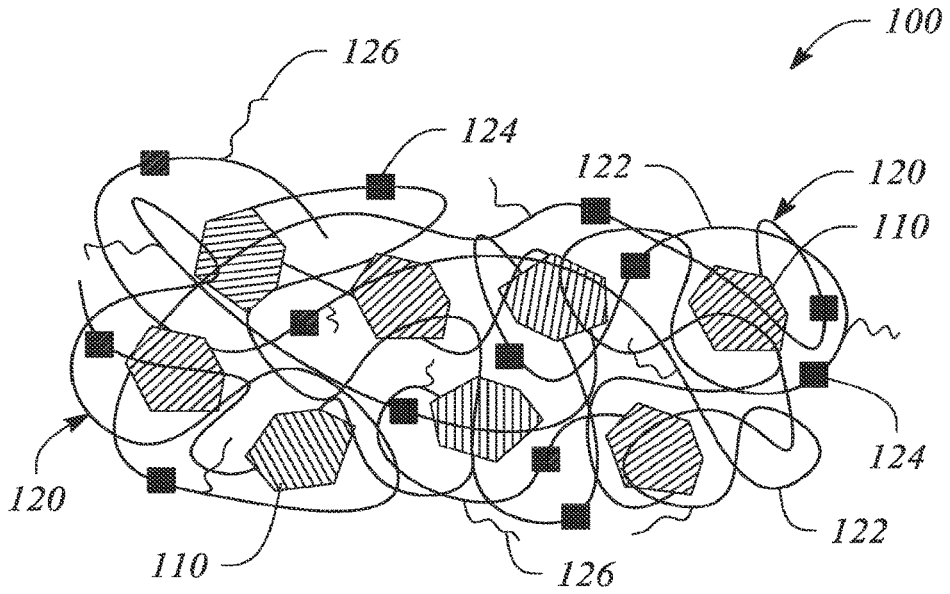
FIG. 1 illustrates a uniform dispersion of a composite coating according to an embodiment of the present invention.

Embodiments of the present invention facilitate adhesion during liquid electrophotographic (LEP) printing. In particular, adhesion between a substrate to be printed and an LEP ink may be enhanced, according to the present invention. The embodiments of the present invention include a composite coating that is intended for application by a substrate manufacturer. The composite coating includes a mineral pigment and a polymeric organic binder with a polar component and a nonpolar component. The LEP ink also has a polar component and a nonpolar component. The composite coating facilitates adhesion of the LEP ink to the substrate using enhanced adhesive interactions. The enhanced adhesive interactions comprise both a dispersive energy interaction between respective nonpolar components of the composite coating and the LEP ink and a polar interaction between respective polar components of the composite coating and the LEP ink. In some embodiments, the sum of the dispersive energy interaction and the polar interaction is maximized by the composite coating. Maximizing both dispersive energy and polar interactions facilitates adhesion between the LEP ink and the substrate in a shortest amount of time in LEP printing.

The composite coating provides an amount of polar functional groups to compatibly interact with available polar functional groups provided by the LEP ink without disrupting dispersive energy interactions. Moreover, the organic binder has sufficient polar functional groups to interact with both the mineral pigment of the composite coating and the substrate surface. The amount of the polar functional groups provided by the organic binder does not hinder the dispersive energy interactions between respective nonpolar components of the composite coating and the LEP ink. The interactions between the respective polar components include one or more of hydrogen bonding, acid-base interactions (i.e., ionic bonding) and van der Waals forces. In particular, the organic binder comprises a hydroxylated polymer. The hydroxylated polymer has sufficient hydroxyl groups to interact with available acidic groups in the LEP ink as well as interacting with the mineral pigment and the substrate surface.

An LEP ink comprises a carrier liquid and polymer-based pigment particles dispersed in the carrier liquid and is sometimes referred to as a 'liquid toner'. The polymer-based pigment particles are either electrically charged or are at least capable of being electrically charged. The electrical charge of the pigment particles is employed to control a deposition location of the particles during LEP printing. Examples of LEP inks and constituent pigment particles thereof are described in a number of U.S. patents including, but not limited to, U.S. Pat. Nos. 4,794,651, 4,842,974, 6,146,803, 6,623,902 and 7,078,141, all of which are incorporated by reference herein. In some embodiments, the LEP ink comprises a commercially available polymer-based LEP ink such as, but not limited to, HP ElectroInk. ElectroInk® is a registered trade mark of Indigo, N.V., The Netherlands, and is owned and marketed by Hewlett-Packard Development Company, Texas (hereinafter 'Hewlett-Packard' or 'HP'), the assignee of the present invention.

HP makes both digital LEP printing presses and LEP inks that are used with the HP digital LEP printing presses. Some of the digital LEP printing presses made by HP are referred to as digital HP Indigo presses. The HP ElectroInk comprises charged polymer-based pigment particles having a very small particle size, as small as a micron, in a liquid carrier. For example, HP ElectroInk may comprise a combination of different resins in an isoparaffin liquid solvent (e.g., Isopar®) as a carrier liquid. Isopar® is a registered trademark of ExxonMobile, NJ. Hereinafter, the carrier liquid is referred to as being an 'oil-based' carrier liquid for simplicity of discussion.

The resins are charged with a combination of lecithin, basic barium petronate and a sulfonate stabilizer, for example. Typical resins used in HP ElectroInk include, but are not limited to, a polyethylene methacrylic acid (PEMAA) copolymer and polyethylene acrylic acid (PEAA) copolymer. See U.S. Pat. No. 7,078,141, for example, which is incorporated by reference in its entirety herein. As such, the polar functional groups of the HP ElectroInk LEP ink comprise carboxylic acid groups and the nonpolar component is a polyethylene hydrocarbon chain. Other polymer resins may comprise a blend of polymers, a blend of copolymers and a blend of polymers and copolymers (i.e., a 'polymer blend').

Herein, reference to a 'LEP ink' explicitly includes all liquid toners, such as, but not limited to, those marketed as HP ElectroInk or equivalent thereto, unless otherwise stated. In addition to ethylene acrylic acid and methacrylic acid copolymers of HP ElectroInk mentioned above, the polymer blend may comprise various polymer and copolymer resins including, but are not limited to, ethylene acrylic acid copolymer, acid-modified ethylene acrylate copolymer, copolymer of ethylene-glycidyl methacrylate, terpolymer of ethylene-methyl acrylate-glycidyl methacrylate, and similar, related resin compounds.

As mentioned above, HP ElectroInk and other equivalent liquid toners (i.e., LEP inks) generally employ toner particles having a size range of 1 micron or smaller. By comparison, dry toners typically employ much bigger toner particles (e.g., typically 3-10 microns) since smaller particles used as a dry toner cannot be readily controlled and effectively guided during printing. Liquid toner overcomes the control problem of small particles by the addition of the liquid carrier, among other mechanisms. Furthermore, HP ElectroInk fuses at less than 100 degrees Celsius (C). The Isopar® carrier liquid has a boiling point of 189 degrees C. but begins to evaporate around 100 degrees C. and exhibits a relatively higher evaporation rate in a temperature range between 120 and 130 degrees C. Dry toners typically require 140-160 degrees C. for fusing, which can severely limit a selection of substrate materials that may be employed. Using an LEP ink such as HP ElectroInk facilitates a wider choice of substrate materials especially when considering flexible and/or organic material-based substrates for LEP printing. Similarly, the polymer-based liquid toners typically produce a more flexible printed image than is possible with dry toners such that the use of LEP inks for LEP printing applications involving flexible substrates is further facilitated.

Thermal offset LEP printing is a type of LEP printing. In thermal offset LEP printing, a pattern (e.g., mask pattern) is created and optically written onto an electrophotographic photosensitive imaging plate (PIP). For example, the PIP may be scanned by an array of lasers under control of a digitally defined pattern. The LEP ink is then sprayed, rolled or otherwise applied onto the PIP in an inking operation. A desired pixel pattern on the PIP is produced by a developer roller. Charged toner particles of the LEP ink preferentially adhere to image areas of the PIP and are removed from non-image areas such that the remaining LEP ink takes on the desired pixel pattern of the PIP.

The patterned LEP ink is transferred to an electrically charged blanket of an offset or transfer cylinder. The patterned LEP ink is heated on the transfer cylinder to remove the carrier liquid and to partially melt and fuse the toner particles. The melting and fusing causes the toner particles to coalesce into a relatively smooth, continuous film. The fused toner particles essentially form a hot adhesive-like plastic on the transfer cylinder blanket while retaining the pattern. Finally, the fused toner particles on the blanket of the transfer cylinder are brought into contact with and transferred to the substrate. Examples of offset LEP printers that may be used to deposit the LEP ink as a patterned toner onto the substrate according to the present invention include, but are not limited to, the HP Indigo press ws4050, the HP Indigo press ws4500, and the HP Indigo press 5000 series printers, all products of Hewlett-Packard.

In addition, most offset thermal LEP printers are color printers that have an ability to deposit each of several colors of LEP ink onto a substrate. Such LEP printers often deposit multiple colors onto the transfer cylinder prior to transferring the color image to the substrate as a normal part of printing a color image. As such, advantage may be taken of this inherent ability to print multiple colors by 'stacking' LEP inks that represent different colors to produce the desired multiple layers of LEP ink. In stacking, LEP ink representing each of several colors is printed in a common region of the image, one on top of the other. Adhesion of the stacked LEP ink layers to the substrate during LEP printing is of particular importance to a user or a recipient of LEP printed matter.

For simplicity of discussion only, the term 'substrate' refers to one or both of a 'coated substrate' and an 'uncoated substrate', unless otherwise specified. The 'coated substrate' is a substrate that has been coated by a substrate manufacturer to add features including, but not limited to, brightening, durability and smoothness, for example. An 'uncoated substrate' is the substrate without any such added features. Further, all quantities provided herein are approximate and may vary, for example, between 1% and 80% of the specified amount. Moreover, as used herein, the article 'a' is intended to have its ordinary meaning in the patent arts, namely 'one or more'. For example, 'a pigment' means one or more pigments and as such, 'the pigment' means 'the pigment(s)' herein. Moreover, any reference herein to 'top', 'bottom', 'upper', 'lower', 'left' or 'right,' for example, is not intended to be a limitation herein. Further, examples herein are intended to be illustrative only and are presented for discussion purposes and not by way of limitation.

In some embodiments of the present invention, a composite coating for a substrate is provided. FIG. 1 illustrates a uniform dispersion of a composite coating 100 according to an embodiment of the present invention. The composite coating 100 comprises a mineral pigment 110 and an organic binder 120. The mineral pigment 110 and the organic binder 120 are uniformly dispersed in water (not illustrated) during mixing. By 'uniformly dispersed' or 'uniform dispersion', it is meant that the organic binder 120 intimately wraps around particles of the mineral pigment 110 and intertwines on itself, as illustrated by way of example in FIG. 1. In some embodiments, a surfactant (not illustrated) may be added during mixing to enhance the uniform dispersion of components. For example, a surfactant such as sodium dodecyl sulfate (SDS) may be added. Moreover, the aqueous medium of the composite coating 100 facilitates both mixing of components and application of the composite coating 100 to a substrate. After application, the water is evaporated from the surface of the substrate, such that the substrate comprises a dried composite coating 100 incorporated into or on the substrate surface.

In some embodiments, the mineral pigment 110 comprises one or more of titanium dioxide, precipitated calcium carbonate, ground calcium carbonate and clay. In other embodiments, the mineral pigment 110 further comprises one or more of talc, alumina and gypsum. An amount of the mineral pigment 110 in the composite coating 100 ranges from 4.5 percent (%) by weight to 9.5% by weight of the aqueous mixture. In some embodiments, the amount of mineral pigment 110 is 5% by weight of the aqueous mixture. The mineral pigment 110 has a particle size that is less than 1 micron (i.e., the mineral pigment 110 comprises nanoparticles). In particular, in some embodiments, the particle size of the mineral pigment 110 ranges from 50 nanometers to 350 nanometers. In other embodiments, an average particle size of the mineral pigment 110 ranges from 200 nanometers to 800 nanometers.

For example, the mineral pigment 110 may comprise titanium dioxide ($TiO_2$) from Tronox, Inc., Oklahoma City, Okla. (a spin-off of Kerr-McGee Chemical Corporation). For example, $TiO_2$, product no. CR-828, has a particle size of 0.19 microns. In another example, the mineral pigment 110 may comprise precipitated calcium carbonate (PCC or precipitated $CaCO_3$) from Specialty Minerals, Bethlehem, Pa. For example, an Albaglos® PCC slurry, has an average particle size of 0.8 microns. Albaglos® is a registered trademark of Specialty Minerals.

The mineral pigment 110 enhances structural integrity of the composite coating 100 and facilitates a final surface roughness (i.e., of the dried composite coating 100 on the substrate) that is comparable to a surface roughness of the printed LEP ink. By comparable, it is meant that the composite coating 100 has a final surface topography that facilitates or takes care of any variations in the pigment particle size of the LEP ink. In some embodiments, a final surface topography of the composite coating 100 with a root-mean-square surface roughness ranging from 50 nanometers to 500 nanometers is adequate to facilitate the variations in the particle size of the LEP ink particles.

The organic binder 120 comprises a hydroxylated polymer 122 having an average molecular weight that is greater than 50,000 (i.e., a high polymer). In some embodiments, the average molecular weight of the hydroxylated polymer 122 ranges from 100,000 to 200,000. The hydroxylated polymer 122 comprises a relatively flexible carbon backbone and spatially accessible functional groups. These characteristics of the hydroxylated polymer 122 facilitate wrapping around the mineral pigment 110 particles and further intertwining with itself. Moreover, these characteristics facilitate interactions with the substrate that provide enhanced mechanical interlocking and van der Waals interaction with the substrate. An amount of the organic binder 120 in the composite coating 100 ranges from 0.5% to 2% by weight of the aqueous mixture. In some embodiments, the amount of organic binder 120 ranges from at least 1% by weight to 2% by weight of the aqueous mixture.

In some embodiments, a ratio of the organic binder 120 to the mineral pigment 110 in the composite coating 100 is targeted such that a ratio of hydrophobic groups to hydrophilic groups at least matches a ratio of hydrophobic groups to hydrophilic groups of the LEP ink that is ultimately LEP printed on a substrate coated with the composite coating 100. By 'hydrophobic groups,' it is meant that the organic binder 120 comprises organic moieties that are basically nonpolar. By 'hydrophilic groups,' it is meant that the organic binder 120 comprises organic moieties and hydroxyl groups 124 that are basically polar (e.g., contain highly electronegative elements, such as oxygen and nitrogen).

Moreover, a weight percentage of hydroxyl groups 124 in the hydroxylated polymer 122 is equal to or greater than a weight percentage of acidic groups in the LEP ink. The relationship between functional groups of the hydroxylated polymer 122 and the LEP ink facilitates adhesive interactions of the LEP ink to the substrate material during liquid electrophotographic (LEP) printing. For example, if the LEP ink particles have 10% by weight of acidic groups, the composite coating 100 should have at least 10% by weight of hydroxyl groups 124 and at most 70% by weight of hydroxyl groups 124. Some of the additional hydroxyl groups 124 in the hydroxylated polymer 122 further facilitate adhesive interactions of the composite coating 100 to the substrate, while other additional hydroxyl groups 124 enhance adhesive interaction of the organic binder 120 with the mineral pigment 110 during mixing.

In some embodiments, the molecular weight of the hydroxylated polymer 122 is scaled in accordance with the particle size of the mineral pigment 110. For example, if the particle size of the mineral pigment 110 used in the composite coating 100 is greater than 350 nanometers, the average molecular weight of the hydroxylated polymer 122 used will increase accordingly. In another example, the amount of the hydroxylated polymer 122 in the composite coating 100 will increase with a greater particle size of the mineral pigment 110. This correlation between the mineral pigment 110 and the hydroxylated polymer 122 one or both of ensures uniform mixing, and provides a targeted structural arrangement and conformation of the components of the uniformly dispersed composite coating 100, as described above.

In some embodiments, the hydroxylated polymer 122 has a general chemical structure of R1-(CR3R4-CR5OH)$_n$—R2, where R1, R2, R3, R4 and R5 are respective chemical substituents 124, 126. Each of the chemical substituents R1, R2, R3, R4 and R5 independently are one of a hydrogen (H), a hydroxyl group (OH) 124 and an organic compound 126. In some embodiments, the organic compound 126 has from one to 10,000 carbons and comprises one or more of an alkyl group, an alkoxy group, an aryl group, an amine group, an amide group, an acrylate, an ester, a phenol, a peptide, an organohalide, a carbohydrate, quaternary ammonium compound, a heterocyclic compound and a polycyclic compound. The quantity n ranges from 1 to 10,000. In some embodiments, the hydroxylated polymer 122 is an atactic macromolecule. By 'atactic', it is meant herein that one or more substituent groups are placed randomly along the polymer backbone. For example, the —(CR3R4-CR5OH)$_n$— group repeats in an irregular fashion along the atactic polymer backbone.

In some embodiments, the hydroxylated polymer 122 of the organic binder 120 comprises a polyvinyl alcohol. The polyvinyl alcohol is 98-99% hydrolyzed and has an average molecular weight greater than or equal to 130,000. Polyvinyl alcohol, 98-99% hydrolyzed, (e.g., CAS #9002-89-5) may be obtained from Sigma Aldrich, St. Louis, Mo., for example. In some embodiments, the polyvinyl alcohol is an atactic polymer, wherein at least the hydroxyl (OH) groups 124 are placed randomly along the polymer backbone. As such, in some embodiments, the —($CH_2$—CHOH)$_n$— group of the polyvinyl alcohol repeats irregularly along the polymer backbone.

In some embodiments, the hydroxylated polymer 122 of the organic binder 120 comprises 1% to 2% by weight of a starch. The starch is a soluble and hydrolyzed starch, for example, product no. S-516 from Fisher Scientific, Fairlawn, N.J. (e.g., corn starch, CAS#9005-25-8). In other embodiments, the organic binder 120 comprises both the polyvinyl alcohol (98-99% hydrolyzed, molecular weight greater than or equal to 130,000) and the starch, each in an amount that is 1% by weight of the aqueous mixture. In some embodiments, the organic binder 120 comprises the hydroxylated polymer 122 and one or more of a polyamide, a polyurethane, a styrene-butadiene copolymer and polyethylene. In other embodiments, the hydroxylated polymer 122 comprises one or more of the polyamide, the polyurethane, the styrene-butadiene copolymer and the polyethylene as a chemical substituent R group 126 (i.e., one or more of R1, R2, R3, R4 and R5). As such, the organic binder 120 may have a complex branched chain chemical configuration to facilitate wrapping around the mineral pigment and intertwining with itself. The complex branched chain configuration provides hydrophobic R groups 126 and hydrophilic R groups 126 that are accessible for bonding and other adhesion-type interactions.

In some embodiments of the present invention, a digital-printing substrate for LEP printing is provided. The digital-printing substrate comprises a substrate material that is compatible with both the LEP printing process and equipment. The substrate material includes, but is not limited to, paper, various plastics and metal. In some embodiments, the substrate material is a specialized commercial paper, namely a digital paper. Manufacturers of digital paper include, but are not limited to, Global Fibres, Inc., NJ, wholly owned by Hansol Paper in Korea (e.g., Titan Plus paper); NewPage Corporation, Miamisburg, Ohio (e.g., Sterling Ultra Indigo and Sterling Ultra Digital papers); SMART Papers, Hamilton, Ohio (e.g., KromeKote C2S, KromeKote C1S and Pegasus papers); Stora Enso, Helsinki, Finland (e.g., Futura Laser Gloss paper); and Condat, Paris, France (e.g., Condat Digital 135 gsm).

The digital-printing substrate further comprises a composite coating incorporated on or in a surface of the substrate material. By 'incorporated on or in', it is meant that the composite coating is applied either during or after the manufacture of the substrate material. The surface of the substrate material is a substrate surface used for receiving an LEP ink during LEP printing. The composite coating is any of the composite coating 100 embodiments described above according to the present invention after the water or aqueous medium is evaporated. For example, in some embodiments of the digital-printing substrate, the aqueous mixture of the composite coating is applied to the as-manufactured substrate material and then dried on the substrate surface. In another example, the aqueous mixture of the composite coating is applied to the substrate material during or near a last step in the manufacture of the substrate material, and then both the substrate material and the composite coating are dried together to form a composite-coated substrate. In either example, the digital-printing substrate is tack-free and ready for use.

The digital-printing substrate (i.e., the composite-coated substrate) has one or both of a surface micro-roughness and a porosity that facilitate adhesion of the digital-printing substrate with the LEP ink. For example, the LEP ink comprises pigment particles in an oil-based carrier liquid, as described above. Once printed on the substrate, the carrier liquid will seek relatively lower positions in the surface topography of the substrate surface while the pigment particles fused together and to the digital-printing substrate during LEP printing. The composite coating on the digital-printing substrate provides one or both of sufficient micro surface roughness and porosity for the carrier liquid to move out of the way of the LEP ink pigment particles and to eventually evaporate. In particular, the carrier liquid may one or both settle in micro crevices of the composite-coated substrate surface and diffuse into pores of the composite-coated substrate surface such that the carrier liquid can evaporate while the LEP ink pigment particles fuse and bond to the digital-printing substrate.

In some embodiments, the substrate material of the digital-printing substrate already comprises a coating. For example, the substrate material may be a digital paper, as mentioned above, having any one or more of brighteners, stiffeners, and even adhesion enhancers (i.e., surface treatment or primers), for example, incorporated into the substrate material or on a printing surface of the substrate material. The composite coating 100 embodiments of the present invention enhance the adhesion of both uncoated substrate materials and coated substrate materials with the LEP ink according to the digital-printing substrate embodiments of the present invention.

In some embodiments, the composite coating 100 replaces various surface treatments or primers for substrates. As mentioned above, commercially available surface primers are either intended for application by a user of an LEP printing press or are applied by the substrate manufacturer and as such, render the substrate with a shelf life. For example, such surface treatments include, but are not limited to, Indigo Sapphire by Hewlett-Packard, Indigo Topaz by Hewlett-Packard, and DigiPrime® substrate primers by Michelman, Inc., Cincinnati, Ohio (e.g., product no. DP 4431 or DP 1000E). DigiPrime® is a registered trademark of Michelman, Inc.

Figure 2:
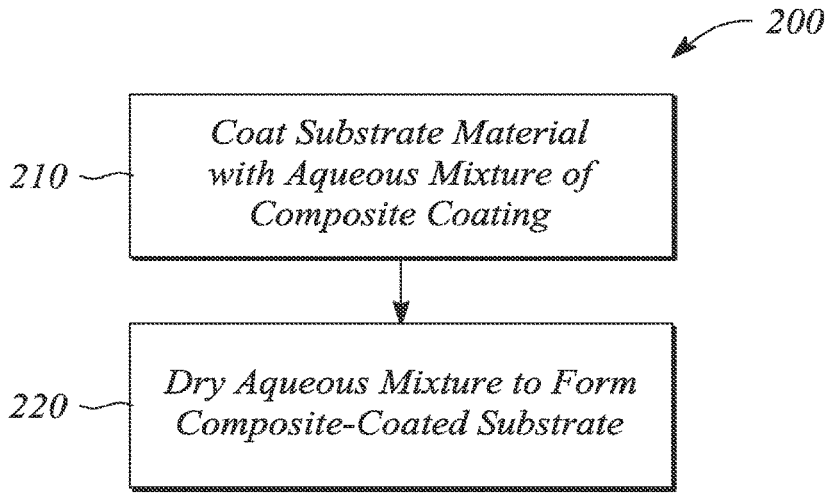
FIG. 2 illustrates a flow chart of a method of improving adhesion of a substrate to a liquid electrophotographic (LEP) ink in LEP printing according to an embodiment of the present invention.

In some embodiments of the present invention, a method of improving adhesion of a substrate to an LEP ink in LEP printing is provided. FIG. 2 illustrates a flow chart of the method 200 of improving adhesion according to an embodiment of the present invention. The method 200 comprises coating 210 a substrate material with an aqueous mixture of a composite coating and drying 220 the aqueous mixture on the substrate material to form a composite-coated substrate. The aqueous mixture of a composite coating is the aqueous mixture of the composite coating 100 according to any of the embodiments described above. The substrate material is any embodiment of the substrate material described above. Moreover, the composite-coated substrate is the digital-printing substrate according to any of the embodiments described above.

In some embodiments, coating 210 a substrate material with an aqueous mixture of a composite coating comprises combining the mineral pigment with the organic binder in water to make a composite slurry. Coating 210 a substrate material further comprises mixing the composite slurry by shaking the combined ingredients for a time ranging from 5 hours to 24 hours or until the mineral pigment and the organic binder are uniformly dispersed in the aqueous mixture. In some embodiments, mixing the composite slurry by shaking comprises using a commercially available orbital shaker. For example, Cole-Parmer Instrument Company, Vernon Hills, Ill. makes a number of orbital shakers suitable for mixing the composite slurry.

Coating 210 a substrate material further comprises ultrasonically treating the aqueous mixture for a time ranging from 10 minutes to 30 minutes to break up any agglomerations in the aqueous mixture. Ultrasonic processors or deagglomerators are commercially available, for example, by Hielscher USA, Inc. Ringwood, N.J. The ultrasonic treatment may be performed immediately after mixing the aqueous mixture. In addition or alternatively, the ultrasonic treatment may be performed just before the aqueous mixture is to be applied to the substrate material. The ultrasonic treatment will render the aqueous mixture essentially agglomeration-free.

Coating 210 a substrate material further comprises applying an amount of the agglomeration-free aqueous mixture to the substrate material. In some embodiments, the aqueous mixture is applied to the substrate material using a wet draw down rod, either automatic or handheld, for example, those commercially available from US Process Supply, Inc., Chicago, Ill. The amount of the aqueous mixture that is applied using a draw down rod is controllable during application. In some embodiments, the amount of aqueous mixture applied is sufficient to evenly coat the surface of the substrate material such that 20 milligrams per square meter of the composite coating is present after drying. The thinner the application, the more likely that the polar components and the nonpolar components of the composite coating are available to interact with each of the substrate material and the LEP ink.

In some embodiments (not illustrated), the method 200 of improving adhesion further comprises printing an LEP ink on the composite-coated substrate using LEP printing. Any commercially available LEP printing press, such as those mentioned above, may be used to print the LEP ink, for example, an HP Indigo printing press. Moreover, the LEP ink may be any of the HP ElectroInks described above due to the polar component of these LEP inks. For example, ElectroInk 4.0 may be used.

The composite coating enhances one or more of van der Waals forces, dispersive energy interaction, hydrogen bonding, ionic bonding and acid-base interactions between the substrate material and the LEP ink in accordance with the various embodiments of the present invention. The method 200 of improving adhesion further comprises heating the composite-coated substrate to evaporate any volatiles left in the printed LEP ink. For example, heating facilitates the evaporation of the oil-based carrier liquid, as described above.

Exemplary composite coatings 100 were prepared and applied to paper substrates according to the present invention. The composite-coated substrates were printed with an LEP ink and adhesion of the LEP ink was evaluated. Adhesion of the LEP ink to the digital-printing substrates of the present invention was evaluated in several ways. A peel test similar to the ASTM F2226-03 standard was used to measure 'short term adhesion' e.g., soon after printing the substrate. For example, a 3M brand 230 tape was pressed on specially prepared print samples by a 4.5 lb HR-100 rubber roller from Cheminstruments Inc., OH, for 10 cycles at different time intervals after printing. The tape was peeled at 180 degrees at a specific speed. The peeled ink sample was then image processed to find the ink remaining on the surface and to assign a peel number. This peel test is useful for evaluating short-time performance of print quality.

Moreover, a test that measured a force needed to pull the ink from digital-printing substrates of the present invention similar to standard ASTM D 3330 was used to measure 'long term adhesion' e.g., 2 hours after printing the substrate. Much stronger adhesive tapes were used and pressed well on top of the ink and paper. The force used to remove the much stronger adhesive tapes was measured using Cheminstruments AR-1000 adhesion-release tester. It was not always possible to remove 100% of the ink from the substrates and a threshold of ink damage was taken as 10% total damage. The tape pull velocity versus the force per unit length (i.e. total force measured by the load cell of AR-1000 divided by the width of the adhesive tape) was plotted. The resulting data points were then fitted by a straight line and the line was mathematically interpolated to zero tape pull speed to obtain work of adhesion (WA).

A commercially available digital paper was chosen for its relatively poor adhesion with HP ElectroInk. Samples of the paper were prepared with various composite coating 100 embodiments of the present invention and then printed with HP ElectroInk. These samples were compared to a sample of the paper without any composite coating embodiments of the present invention, as a control, also printed with ElectroInk. The control paper sample had a work of adhesion of 308 Newton/meters (N/m). In general, the composite coating embodiments significantly improved the work of adhesion with respect to the control paper sample.

Most of the composite coating 100 embodiments improved the work of adhesion at least approximately two-fold. For example, most of the various embodiments of the composite coating 100 on the digital paper at least doubled the work of adhesion for the same HP ElectroInk. The composite coating 100 sample comprising 1% by weight Starch as the hydroxylated polymer had less than a two-fold increase in the work of adhesion and the 2% by weight Starch sample had about a two-fold increase. Moreover, the composite coating 100 embodiments comprising polyvinyl alcohol (PVA) approximately quadrupled the work of adhesion for most samples. Only the composite coating 100 embodiment comprising PVA and a styrene butadiene rubber (SBR) copolymer had a lower work of adhesion, but still was more than doubled the control paper sample. Table 1 compares the work of adhesion for some exemplary embodiments of the composite coating 100 of the present invention.

TABLE 1

Comparison of various embodiments of the composite coating in terms of approximate Work of Adhesion (WA). Amounts in (%) are approximate percents by weight.

| Paper + (Composite Coating Embodiments) | WA |
|---|---|
| Digital Paper only (Paper) - Control | 308 N/m |
| Paper + (5% CaCO3 + 1% PVA) | >1158 N/m |
| Paper + (5% CaCO3 + 1% PA) | 694 N/m |
| Paper + (5% CaCO3 + 1% SBR) | 672 N/m |
| Paper + (5% CaCO3 + 1% SBR + 1% PVA) | 772 N/m |
| Paper + (5% CaCO3 + 1% Starch) | 540 N/m |
| Paper + (5% CaCO3 + 2% Starch) | 600 N/m |
| Paper + (5% CaCO3 +1% Starch + 1% PVA) | >1235 N/m |

Thus, there have been described embodiments of a composite coating, a digital-printing substrate and a method of improving adhesion in LEP printing that enhance adhesion between a substrate material and an LEP ink. It should be understood that the above-described embodiments are merely illustrative of some of the many specific embodiments that represent the principles of the present invention. Clearly, those skilled in the art can readily devise numerous other arrangements without departing from the scope of the present invention as defined by the following claims.

What is claimed is:

1. A method of improving adhesion of a substrate to a liquid electrophotographic (LEP) ink in LEP printing, the method comprising:

coating a substrate material with a composite coating, the composite coating comprising 4.5% to 9.5% by weight of a mineral pigment and 0.5% to 2% by weight of an organic binder uniformly dispersed in an aqueous medium, the mineral pigment having a particle size less than 1 micron, the organic binder comprising a hydroxylated polymer having an average molecular weight greater than 50,000, a weight percentage of hydroxyl groups in the hydroxylated polymer being equal to or greater than a weight percentage of acidic groups in the LEP ink;

drying the composite coating on the substrate material to form a composite-coated substrate; and printing the LEP ink on the composite-coated substrate using the LEP printing.

2. The method of improving adhesion of claim 1, further comprising:

heating the composite-coated substrate to evaporate any volatiles left in the printed LEP ink.

3. The method of improving adhesion of claim 1, wherein coating the substrate material comprises:

combining the mineral pigment with the organic binder in water to make a composite slurry;

mixing the composite slurry by shaking for a time ranging from 5 hours to 24 hours until the mineral pigment and the organic binder are uniformly dispersed;

ultrasonically treating the aqueous uniform dispersion for a time ranging from 10 minutes to 30 minutes to break up any agglomerations; and applying an amount of the agglomeration-free aqueous uniform dispersion to the substrate material sufficient to coat a surface of the substrate material.

4. The method of improving adhesion of claim 1, wherein the dried composite coating enhances one or more of van der Waals forces, dispersive energy, hydrogen bonding, ionic bonding and acid-base interactions between the substrate material and the LEP ink.

5. The method of improving adhesion of claim 1, wherein the particle size of the mineral pigment ranges from 50 nanometers to 350 nanometers.

6. The method of improving adhesion of claim 1, wherein the hydroxylated polymer comprises a polyvinyl alcohol that is 98-99 % hydrolyzed, the average molecular weight of the polyvinyl alcohol ranging from 100,000 to 200,000.

7. The method of improving adhesion of claim 1, wherein the weight percentage of hydroxyl groups in the hydroxylated polymer is less than or equal to 70 weight percent.

8. The method of improving adhesion of claim 1, wherein the hydroxylated polymer has a general chemical structure of $$R1\text{-}(CR3R4\text{-}CR5OH)_n\text{—}R2$$

where R1, R2, R3, R4 and R5 are independently one of a hydrogen, a hydroxyl group and an organic compound having from one to 10,000 carbons, the organic compound comprising one or more of an alkyl, an alkoxy, an aryl, an amine, an amide, an acrylate, an ester, a phenol, a peptide, an organohalide, a carbohydrate, quaternary ammonium compound, a heterocyclic compound and a polycyclic compound, and where n ranges from 1 to 10,000.

9. The method of improving adhesion of claim 1, wherein the hydroxylated polymer is an atactic macromolecule.

10. The method of improving adhesion of claim 1, wherein the mineral pigment comprises one or more of titanium dioxide, precipitated calcium carbonate, ground calcium carbonate and clay, an amount of the mineral pigment in the composite coating being 5% by weight, the particle size of the mineral pigment being less than or equal to 0.8 microns.

11. The method of improving adhesion of claim 1, wherein an amount of the mineral pigment in the composite coating is 5% by weight, the mineral pigment comprising one or both of precipitated calcium carbonate and titanium dioxide, the particle size of the mineral pigment being less than or equal to 0.8 microns, and wherein an amount of the organic binder in the composite coating is from 1% to 2% by weight, the organic binder comprising polyvinyl alcohol and a soluble starch, the polyvinyl alcohol being 98% to 99% hydrolyzed, the average molecular weight of the polyvinyl alcohol being 130,000.

12. The method of improving adhesion of claim 1, wherein the hydroxylated polymer has a ratio of hydrophobic groups to hydrophilic groups that is equivalent to a ratio of hydrophobic groups to hydrophilic groups of the LEP ink, the hydrophobic groups facilitating additional adhesion between the substrate and the LEP ink.

13. The method of improving adhesion of claim 1, wherein the dried composite coating has one or both of a surface roughness and a porosity that facilitate the adhesion with the LEP ink.

14. The method of improving adhesion of claim 1, wherein the LEP ink comprises toner particles, wherein the toner particles comprise a polymer blend comprising an ethylene acrylic acid copolymer, an ethylene methacrylic acid copolymer, an acid-modified ethylene acrylate copolymer, an ethylene-glycidyl methacrylate copolymer, an ethylene-methyl acrylate-glycidyl methacrylate terpolymer, or a combination thereof.

15. The method of improving adhesion of claim 1, wherein the LEP ink comprises toner particles having a size range of 1 micron or smaller.

* * * * *